United States Patent [19]

Payne et al.

[11] 3,998,750

[45] Dec. 21, 1976

[54] LIQUID DETERGENT COMPOSITION

[75] Inventors: Nicholas Stockford Payne, Cincinnati, Ohio; Ronald Lynn Bailey, Kobe, Japan

[73] Assignee: The Procter & Gamble Company, Cincinnati, Ohio

[22] Filed: June 30, 1975

[21] Appl. No.: 592,009

[52] U.S. Cl. ..... 252/108; 252/122; 252/550; 252/551; 252/554; 252/555; 252/558; 252/559; 252/DIG. 14

[51] Int. Cl.[2] ..... C11D 1/12; C11D 1/83

[58] Field of Search ..... 252/89, 108, 550, 551, 252/555, 558, 559, 543, DIG. 14, 301.2 W, 122, 554; 260/507 A

[56] References Cited

UNITED STATES PATENTS

| | | | |
|---|---|---|---|
| 2,766,212 | 10/1956 | Grifo | 252/541 |
| 2,908,651 | 10/1959 | Grifo | 252/153 |
| 3,282,852 | 11/1966 | Trusler et al. | 252/89 X |
| 3,726,814 | 4/1973 | Lancz | 252/543 |
| 3,781,204 | 12/1973 | Katsumi et al. | 252/8.75 |
| 3,812,041 | 5/1974 | Inamorato | 252/89 |
| 3,904,544 | 9/1975 | Clark et al. | 252/301.2 W |

FOREIGN PATENTS OR APPLICATIONS

| | | |
|---|---|---|
| 548,627 | 11/1957 | Canada |

*Primary Examiner*—P.E. Willis, Jr.
*Attorney, Agent, or Firm*—Jerry J. Yetter; George Galanes; William H. Gould

[57] ABSTRACT

Clear, single-phase, heavy-duty liquid detergent compositions are formulated using alkaline earth cations to replace a substantial portion of the alkanolamines commonly used in such compositions, thereby avoiding precipitation of bis(styrylsulfonate)biphenyl brightener.

10 Claims, No Drawings

LIQUID DETERGENT COMPOSITION

BACKGROUND OF THE INVENTION

The present invention relates to clear, single-phase liquid detergents. More specifically, compositions comprising an anionic detersive surfactant in its alkaline earth metal form, a nonionic detersive surfactant and bis(styrylsulfonate)biphenyl as a fabric brightener provide superior detergency performance without undesirable precipitation of the brightener.

Heavy-duty, built laundry detergents have historically been provided in the form of granules. More recently, however, it has been recognized that excellent detergency performance can be secured using unbuilt detergents comprising a mixture of detersive surfactants and materials such as alkanolamines. The advent of such compositions has made it possible to provide heavy-duty laundry detergents in liquid form.

Liquid compositions offer several advantages over solid compositions. For example, liquid compositions are easier to measure and dispense into a laundering liquor. More importantly, liquid compositions are especially useful for direct application to heavily soiled areas on fabrics, after which the pre-treated fabrics can be placed in an aqueous bath for laundering in the ordinary manner.

Fabric brighteners, or "optical bleaches", are a well-recognized type of laundering adjunct commonly found in granular detergent compositions. Brighteners are especially useful when laundering white fabrics and, when properly selected and used, contribute substantially to the overall appearance of the laundered fabrics.

Various water-soluble stilbene-based brighteners and their method of preparation are disclosed in Canadian Pat. No. 823,683, 9/23/69, incorporated herein by reference. The bis(styrylsulfonate)biphenyl brightener disclosed in Canadian Pat. No. 823,683 is especially useful, inasmuch as it is stable in the presence of hypochlorite bleaches commonly used in laundering liquors. Unfortunately, however, this brightener is precipitated by the relatively high concentrations of alkanolamines commonly used as detergency boosters and pH control agents in concentrated heavy-duty laundry detergents. Accordingly, it has not been possible heretofore to prepare a clear, homogeneous, builder-free heavy-duty liquid detergent containing an effective level of bis(-styrylsulfonate)biphenyl.

By the present invention it has been discovered that the alkanolamines used in heavy-duty liquids can be omitted, while retaining excellent cleaning performance, if an anionic detersive surfactant component is used in the composition in its magnesium or calcium form and in the manner disclosed hereinafter. While minor amounts (i.e., less than about 1%) of alkanolamines can optionally be present in the compositions herein to adjust pH, the use of detersive amounts (i.e., about 1%, and greater) of the alkanolamines is avoided, thereby overcoming the brightener precipitation problem. Compositions prepared in the manner of this invention provide heavy-duty detergency performance fully equivalent to that of compositions containing high, detersive amounts of alkanolamines. Moreover, the compositions herein are fully compatible with the desirable bis(styrylsulfonate)biphenyl brightener.

The stable, clear, homogeneous liquid detergent compositions provided herein are characterized by their excellent detergency performance and low cost, which is due in part to the replacement of the relatively expensive alkanolamines with an alkaline earth metal, and in part to the use of the quite efficient bis(styrylsulfonate)biphenyl brightener in place of other types of brighteners.

PRIOR ART

The use of magnesium and/or calcium ions in detergent compositions to provide increased detergency benefits has been disclosed heretofore.

U.S. Pat. No. 2,908,651, entitled LIQUID DETERGENT COMPOSITION, Oct. 13, 1959, discloses single-phase, clear, concentrated liquid detergents containing, inter alia, alkanolamines, magnesium or calcium salts, alcohols, and alkyl aryl sulfonates. This patent describes in some detail the problems associated with the preparation of single-phase, clear liquid detergents.

U.S. Pat. No. 2,691,636, entitled DETERGENT COMPOSITIONS, Oct. 12, 1954, relates to synthetic detergent compositions and their use, inter alia, in their calcium and magnesium form.

U.S. Pat. No. 2,766,212, entitled DETERGENTS, Oct. 9, 1956, discloses and claims, inter alia, the use of polyvalent metals such as the chlorides, sulfates, acetates, etc., of magnesium, calcium, etc., in combination with anionic detergents which are sulfated ethoxylated alcohols.

U.S. Pat. No. 3,202,613 entitled PROCESS FOR PRODUCTION OF DETERGENT COMPOSITIONS, Aug. 24, 1965, teaches the use of magnesium sulfate in low bulk density built detergents.

U.S. Pat. No. 3,440,171, entitled SURFACE ACTIVE COMPOSITIONS, Apr. 22, 1969, teaches the use of various salts, including magnesium salts, as degellants for fluid mixtures of alkyl benzene sulfonic acids and alkanolamines.

U.S. Pat. No. 3,282,852, entitled HEAVY DUTY LIQUID DETERGENTS, Nov. 1, 1966, teaches, inter alia, hydrotropes, nonionics and higher alkaryl sulfonates in their alkanolamine or magnesium salt form.

U.S. Reissue Pat. No. Re. 27,096, reissued Mar. 23, 1971, teaches a high sudsing detergent composition comprising a synergistic mixture of olefin sulfonates, alkyl benzene sulfonates and alkyl ether sulfates and teaches that magnesium salts of these materials may be employed.

U.S. Pat. No. 3,718,609, entitled LIQUID DETERGENT COMPOSITIONS, Feb. 27, 1973, relates to dual layer liquid detergents which can contain magnesium surfactants.

U.S. Pat. No. 3,686,098, entitled NOVEL DETERGENT COMPOSITION, Aug. 22, 1972, relates to dianionic detergents and the water-soluble calcium, magnesium, etc., salts thereof.

As can be seen from the foregoing, polyvalent metal ions such as calcium and magnesium have been employed in a variety of detergent compositions. Additional references in this regard include the following:

U.S. Pats. Nos. No. 3,819,539, June 25, 1974; 3,700,607 Oct. 24, 1972; 3,697,587, Oct. 10, 1972; 3,679,611, July 25, 1972; 3,679,609, July 25, 1972; 3,634,269, Jan. 11, 1972; 3,577,347, May 4, 1971 (relating to a stable, non-gritty cleanser composition comprising a detergent mixture which can be an alkyl benzene sulfonate and a nonionic surfactant, certain magnesium salts, and a chlorine bleach); 3,505,395, Apr. 7, 1970; 3,384,595, May 21, 1968; 3,345,300, Oct. 3, 1967; 3,325,412, June 13, 1967; 3,303,137, Feb. 7, 1967; 3,274,117, Sept. 20, 1966; 3,265,624, Aug. 9, 1966 (chlorine bleach-containing composition); 3,256,202, June 14, 1966; 3,053,771, Sept. 11, 1962; 3,072,580, Jan. 8, 1963; 2,857,370, Oct. 21, 1958; 2,731,442, Jan. 17, 1956; 2,166,314, July 18, 1939; 2,562,155, July 24, 1951; 2,037,566, Apr. 14, 1936; 2,658,072, Nov. 3, 1953; and 2,717,243, Sept. 6, 1955.

In addition to the foregoing U.S. Pats. Nos. 3,869,399, issued Mar. 4, 1975, 3,594,323, issued July 20, 1971, and the references cited therein, disclose various heavy duty liquid detergents and the use of high (ca. 1%, and greater) levels of free alkanolamines therein to enhance detergency performance.

It is an object of this invention to provide heavy duty liquid detergents characterized by their superior cleaning performance.

It is another object herein to provide heavy duty liquid detergents comprising a significant amount of an alkaline earth metal salt.

These and other objects are obtained herein as will be seen from the following disclosure.

SUMMARY OF THE INVENTION

The present invention encompasses clear, homogeneous, single-phase, heavy-duty liquid detergent compositions, comprising:

a. from about 10% to about 40% (preferably about 13% to about 40%) by weight based on the free acid form of an anionic detersive surfactant, or mixtures thereof;

b. sufficient alkaline metal cation, especially magnesium ion or calcium ion, or mixtures thereof, to provide electrical neutrality for said anionic surfactant;

c. from about 1o% to about 50% by weight of an ethoxylated nonionic detersive surfactant, or mixtures thereof;

d. an effective amount (i.e., 0.1% to 1%, preferably 0.1% to 0.5%, by weight of composition) of a water-soluble bis(styrylsulfonate)biphenyl brightener; and e. the balance of the composition comprising a liquid carrier selected from water or mixtures of water and water-soluble solvents.

The compositions herein can contain various optional laundry adjuncts, but are formulated in a manner so as to be substantially free of potentially interfering agents at levels which cause phase separation or brightener precipitation (e.g., high levels of agents such as alkanolamines and/or electrolytes).

The compositions herein are in concentrated form and usually will comprise from about 30% to about 50%, by weight of composition, of the total anionic (calculated as the free acid form) plus nonionic surfactants. Compositions containing 70%–80% total surfactant can be formulated, if desired.

Especially preferred concentrated liquid compositions herein are those where the weight ratio of nonionic surfactant to anionic surfactant (free acid form) is in the range from 40:13 to 10:40, most preferably 25:15 to 10:40.

The invention also encompasses a process for laundering fabrics by contacting said fabrics with an effective amount of a composition of the foregoing type.

DETAILED DESCRIPTION OF THE INVENTION

The compositions herein are specifically designed to provide optimum cleaning benefits when used in either of the two modes commonly employed with liquid detergent compositions. First, the compositions herein can be used as pre-treatment agents which are applied in concentrated form directly onto fabric stains prior to washing. Second, the instant compositions are also useful as detergents for conventional through-the-wash fabric laundering operations. Excellent stain removal and soil removal are attained when an effective amount of the instant compositions is dissolved in an aqueous washing solution. Typical use concentrations are about 0.1% by weight in an aqueous laundering liquor (approximately 30 grams per 30 liters of wash water). For through-the-wash fabric laundering, a concentration in the range of from 0.08% to about 0.20% by weight of the laundering liquor is typical. Of course, this can be adjusted, depending on the soil and fabric load and the desires of the user. For example, under European conditions use levels of about 0.50% are not uncommon.

With regard to pre-treatment efficacy, the instant compositions containing the herein-specified components and component ratios provide oily stain removal from cotton, polyester or polyester/cotton fabrics which is equal or superior to similar pre-treatment performance attained with conventional built anionic detergent compositions. The compositions herein are comparable in oily stain removal performance with pure nonionic surfactants which are known to be particularly useful in pre-treatment stain removal processes. On the other hand the compositions herein are equal or superior to conventional non-ionic surfactant-based products for through-the-wash soil removal (especially from cotton) under standard home laundering conditions. Through-the-wash detergency performance of the instant compositions is comparable with that attained with conventional, built granular anionic detergent compositions containing brighteners, especially with regard to oily stain removal.

The present invention employs multiple components which are described in detail, below.

DETERSIVE SURFACTANTS

The surfactant component of the compositions prepared according to this invention comprises, as essential ingredients, an anionic detersive surfactant and a nonionic detersive surfactant. Additional surfactants, e,g., the semi-polar, zwitterionic and ampholytic surface active agents well known in the detergent arts, can optionally be employed herein as subs modifiers, or for specialized cleaning purposes. Typical anionic, nonionic, etc., surfactants of the type used herein are listed in U.S. Pats. Nos. 3,332,880 and 3,697,364, issued Sept. 26, 1972, to J. B. Edwards, each incorporated herein by reference.

Non-limiting examples of surfactants suitable for use in the instant compositions and processes are as follows.

ANIONIC SURFACTANT

The anionic component of the instant detergent compositions can be an organic sulfuric reaction product having in its molecular structure an alkyl group containing from about 8 to about 22 carbon atoms and a sulfonic acid or sulfuric acid ester group, or mixtures thereof (Included in the term "alkyl" is the alkyl portion of acyl groups.) Examples of this group of synthetic detersive surfactants which can be used in the present invention are the alkyl sulfates, especially those obtained by sulfating the higher alcohols ($C_8$–$C_{18}$ carbon atoms) produced from the glycerides of tallow or coconut oil; and alkyl benzene sulfonates, in which the alkyl group contains from about 9 to about 14 carbon atoms, in straight chain or branched chain configuration, e.g., those of the type described in U.S. Pats. Nos. 2,220,099 and 2,477,383, incorporated herein by reference. Linear straight chain alkyl benzene sulfonates in which the average of the alkyl groups is about 13 carbon atoms, abbreviated as $C_{13}$LAS, as well as mixed $C_{11.2}$ and $C_{11.8}$ (avg.) LAS are typically used. $C_{11}$–$C_{14}$ branched chain alkyl benzene sulfonates (ABS), which are excellent sudsers, can also be used.

Examples of commercially available alkyl benzene sulfonates (free acid form) useful in the instant invention include Conoca SA 515, SA 597, and SA 679, all marketed by the Continental Oil Company, and Calsoft LAS 99, marketed by the Pilot Chemical Company.

Other anionic surfactant compounds herein include the alkyl glyceryl ether sulfonates, especially those ethers of higher alcohols derived from tallow and coconut oil; coconut oil fatty acid monoglyceride sulfonates and sulfates; and alkyl phenol ethylene oxide ether sulfates containing about 1 to about 10 units of ethylene oxide per molecule and wherein the alkyl groups contain about 8 to about 12 carbon atoms.

Other useful anionic surfactants herein include the esters of $\alpha$-sulfonated fatty acids containing from about 6 to 20 carbon atoms in the ester group; 2-acyloxyalkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 30 moles of ethylene oxide; olefin sulfonates containing from about 12 to 24 carbon atoms; and $\beta$-alkyloxy alkane sulfonates containing from about 1 to 3 carbon atoms in the alkyl group and from about 8 to 20 carbon atoms in the alkane moiety.

Anionic surfactants based on the higher fatty acids, i.e., "soaps" are useful anionic surfactants herein. Higher fatty acids containing from about 8 to about 24 carbon atoms and preferably from about 10 to about 20 carbon atoms are useful anionic surfactants in the present compositions. Particularly useful are the soaps derivable from the mixtures of fatty acids made from coconut oil and tallow.

Preferred water-soluble anionic organic surfactants herein include linear alkyl benzene sulfonates containing from about 10 to about 18 carbon atoms in the alkyl group; branched alkyl benzene sulfonates containing from about 10 to about 18 carbon atoms in the alkyl group; the tallow range alkyl sulfates; the coconut range alkyl glyceryl sulfonates; alkyl ether (ethoxylated) sulfates wherein the alkyl moiety contains from about 12 to 18 carbon atoms and wherein the average degree of ethoxylation varies between 1 and 12, especially 3 to 9; the sulfated condensation products of tallow alcohol with from about 3 to 12, especially 6 to 9, moles of ethylene oxide; olefin sulfonates containing from about 14 to 16 carbon atoms; and soaps, as hereinabove defined.

Specific preferred anionics for use herein include: the linear $C_{10}$–$C_{14}$ alkyl benzene sulfonates (LAS); the branched $C_{10}$ to $C_{14}$ alkyl benzene sulfonates (ABS); the tallow alkyl sulfates; the coconut alkyl glyceryl ether sulfonates; the sulfated condensation products of mixed $C_{10}$–$C_{18}$ tallow alcohols with from about 1 to about 14 moles of ethylene oxide; and the mixtures of higher fatty acids containing from 10 to 18 carbon atoms.

It is to be recognized that any of the foregoing anionic surfactants can be used separately herein or as mixtures. Moreover, commercial grades of the surfactants can contain non-interfering components which are processing byproducts. For example, commercial $C_{10}$–$C_{14}$ alkaryl sulfonates can comprise alkyl benzene sulfonates, alkyl toluene sulfonates, alkyl naphthalene sulfonates and alkyl poly-benzenoid sulfonates. Such materials and mixtures thereof are fully contemplated for use herein.

NONIONIC SURFACTANT

The compositions and processes herein also employ a nonionic detersive surfactant. The presence of the nonionic surfactant in the liquid detergent compositions provided by this invention promotes oily stain removal, both in their pre-treatment application and through-the-wash use.

The nonionic surfactants can be prepared by a variety of methods well known in the art. In general terms, such nonionic surfactants are typically prepared by condensing ethylene oxide with an —OH containing hydrocarbyl moiety, e.g., an alcohol or alkyl phenol, under conditions of acidic or basic catalysis.

Nonionic surfactants for use herein comprise the typical nonionic surface active agents well known in the detergency arts. Such materials can be succinctly described as the condensation products of an alkylene oxide (hydrophilic in nature), especially ethylene oxide (EO), with an organic hydrophobic compound, which is usually aliphatic or alkyl aromatic in nature. The length of the hydrophilic (i.e. polyoxyalkylene) moiety which is condensed with any particular hydrophobic compound can be readily adjusted to yield a water-soluble compound having the desired degree of balance between hydrophilic and lipophilic elements, i.e., the HLB.

The HLB of the ethoxylated nonionics used herein can be experimentally determined in well-known fashion, or can be calculated in the manner set forth in Decker, EMULSIONS THEORY AND PRACTICE, Reinhold 1965, pp. 233 and 248. For example, the HLB of the nonionic surfactants herein can be simply approximated by the term: HLB = E/5; wherein E is the weight percentage of ethylene oxide content in the molecule. Of course, the HLB will vary, for a given hydrocarbyl content, with the amount of ethylene oxide.

Preferred nonionic surfactants for use in the present compositions and processes are characterized by an HLB in the range of from 9 to 20, most preferably 10 to 14.

Specific, non-limiting examples of suitable water-soluble nonionic surfactants include the following.

The ethylene oxide condensates of alkyl phenols are a well-known type of water-soluble ethoxylated nonionic surfactant. These compounds include the condensation products of alkyl phenols having an alkyl group containing from about 6 to 18 carbon atoms in either a straight chain or branched chain configuration, with EO, said EO being present in amounts from about 3 to about 25 moles of EO per mole of alkyl phenol. The alkyl substituent in such compounds can be derived, for example, from polymerized propylene, diisobutylene, octene, or nonene. Examples of compounds of this type include nonyl phenol condensed with about 9.5 moles of EO per mole of nonyl phenol; dodecyl phenol condensed with about 12 moles of EO per mole of phenol; dinonyl phenol condensed with about 15 moles of EO per mole of phenol; and di-iooctylphenol condensed with about 15 moles of EO per mole of phenol. Commercially available nonionic surfactants of this type include Igepal CO-630, marketed by the GAF Corporation, and Triton X-45, X-114, X-100 and X-102, all marketed by the Rohm and Haas Company.

The condensation products of aliphatic alcohols with ethylene oxide are another (and highly preferred) type of nonionic surfactant used herein. The alkyl chain of the aliphatic alcohol can be either straight or branched, and generally contains from about 8 to about 22, preferably 9 to 16, carbon atoms. The alcohols can be primary, secondary, or tertiary. Examples of such ethoxylated alcohols include the condensation product of about 6 moles of EO with 1 mole of tridecanol; myristyl alcohol condensed with about 10 moles of EO per mole of myristyl alcohol; the condensation product of EO with coconut fatty alcohol wherein the coconut alcohol is primarily a mixture of fatty alcohols with alkyl chains varying from 10 to about 14 carbon atoms in length and wherein the condensate contains about 6 moles of EO per mole of total alcohol; and the condensation product of about 9 moles of EO with the above-described coconut alcohol. Tallow alcohol ethoxylates $(EO)_6$ to $(EO)_{11}$ are similarly useful herein. Examples of commercially available nonionic surfactants of the foregoing type incude Tergitol 15-S-9, marketed by the Union Carbide Corporation; Neodol 23-6.5, marketed by the Shell Chemical Company; and Kyro EOB, marketed by The Procter & Gamble Company.

The condensation products of ethylene oxide with a hydrophobic base formed by the condensation of propylene oxide with propylene glycol constitute another type of nonionic surfactant. The hydrophobic portion of these compounds has a molecular weight of from about 1500 to 18,000 and, of course, exhibits water insolubility. The addition of poly-EO moieties to this hydrophobic portion tends to increase the water-solubility of the molecule as a whole, and the liquid character of the product is retained up to the point where the EO content is about 50% of the total weight of the condensation product. Examples of compounds of this type include certain of the commercially available Pluronic surfactants, marketed by BASF Wyandotte.

The condensation products of ethylene oxide with the product resulting from the reaction of propylene oxide and ethylenediamine are another type of nonionic surfactant useful herein. The hydrophobic "base" of these condensation products consists of the reaction product of ethylenediamine and excess propylene oxide, said base having a molecular weight of from about 2500 to about 3000. This base compound is thereafter condensed with EO to the extent that the condensation product contains from about 40% to about 80% by weight of poly-EO and has a molecular weight of from about 5,000 to about 11,000. Examples of this type of nonionic surfactant include certain of the commercially available Tetronic compounds, marketed by BASF Wyandotte.

The highly preferred nonionic surfactants herein include the $EO_1$–$EO_{20}$ condensates of $C_9$ to $C_{18}$ primary and secondary alcohols; the condensates of primary alcohols are most preferred. Non-limiting, specific examples of nonionic surfactants of this type are as follows (the abbreviations used for the nonionic surfactants, e.g., $C_{14}(EO)_6$, are standard for such materials and describe the carbon content of the lipophilic portion of the molecule and the ethylene oxide content of the hydrophilic portion) : n-$C_{14}H_{29}(EO)_5$; n-$C_{14}H_{29}(EO)_6$; n-$C_{14}H_{29}(EO)_7$; n-$C_{14}H_{29}(EO)_{10}$; n-$C_{15}H_{31}(EO)_6$; n-$C_{15}H_{31}(EO)_7$; 2-$C_{15}H_{31}(EO)_7$; n-$C_{15}H_{31}(EO)_8$; 2-$C_{15}H_{31}(EO)_8$; n-$C_{15}H_{31}(EO)_9$; 2-$C_{15}H_{31}(EO)_9$; $H_{33}(EO)_9$; and 2-$C_{16}H_{33}(EO)_9$.

It is to be recognized that mixtures of the foregoing nonionic surfactants are also useful herein and are readily available from commercial alcohol mixtures.

It will be appreciated that the degree of ethoxylation in the nonionics listed herein can vary somewhat, inasmuch as average fractional degrees of ethoxylation occur. For example, n-$C_{15}H_{31}(EO)_7$ can contain small quantities of n-$C_{15}H_{31}(EO)_0$ and n-$C_{15}H_{31}(EO)_{14}$. Commercial mixtures will contain portions of materials of varying EO contents, and the stated EO content represents an average. Such mixtures are quite suitable for use in the present compositions and processes.

Highly preferred alcohol-based nonionic surfactants are the $C_{14\text{-}15}(EO)_{6\text{-}9}$ materials disclosed hereinabove, which are commercially available as mixtures under the names Neodol 45-7 and Neodol 45-9 from the Shell Chemical Co. Neodol 45-7 is a liquid at ambient temperatures (and is more preferred herein for this reason) whereas Neodol 45-9 is a solid at room temperature. However, solid nonionics such as Neodol 45-9 are also useful in the instant liquid compositions inasmuch as they readily dissolve therein. Other highly preferred nonionics include Dobanol 91-8 (OXO-based alcohol from Shell) and Softanol, available from Nippon Shokubei.

When using commercial nonionic mixtures, especially of lower ($C_9$–$C_{10}$) alkyl chain length, it is preferred that the un-ethoxylated alcohols and lower $(EO)_1$–$(EO)_2$ ethoxylates be removed, or "stripped", to reduce undesirable odors. Stripping can be done in vacuo or by standard distillation means.

ADJUNCT SURFACTANTS

The compositions and processes herein can optionally employ various other adjunct surfactants which can be used to perform specific cleaning, suds modifying, etc., functions. Such optional surfactants include the various semi-polar, ampholytic, and zwitterionic surface active agents known in the art. Non-limiting examples of such materials are as follows.

Semi-polar surfactants useful herein include water-soluble amine oxides containing one alkyl moiety of from about 10 to 28 carbon atoms and two moieties selected from the group consisting of alkyl moieties and hydroxyalkyl moieties containing from 1 to about 3 carbon atoms; water-soluble phosphine oxides containing one alkyl moiety of about 10 to 28 carbon atoms and two moieties selected from the group consisting of alkyl moieties and hydroxyalkyl moieties containing from about 1 to 3 carbon atoms; and water-soluble sulfoxides containing one alkyl moiety of from about 10 to 28 carbon atoms and a moiety selected from the group consisting of alkyl and hydroxyalkyl moieties of from 1 to 3 carbon atoms.

Ampholytic surfactants include derivatives of aliphatic or aliphatic derivatives of heterocyclic secondary and tertiary amines in which the aliphatic moiety can be straight chain or branched and wherein one of the aliphatic substitents contains from about 8 to 18 carbon atoms, and at least one aliphatic substituent contains an anionic water-solubilizing group.

Zwitterionic surfactants include derivatives of aliphatic quaternary ammonium, phosphonium and sulfonium compounds in which the aliphatic moieties can be straight or branched chain, and wherein one of the aliphatic substituents contains from about 8 to 18 carbon atoms and one contains an anionic water solubilizing group.

The foregoing surfactant types are well known in the detergency arts.

BRIGHTENER

The brightener compounds employed herein are the water-soluble bis(styrylsulfonate)biphenyl compounds known in the detergency art. The bis(styrylsulfonate)-biphenyl brightener is described in great detail in the document, THE CURRENT STATUS OF HUMAN SAFETY AND ENVIRONMENTAL ASPECTS OF FLUORESCENT WHITENING AGENTS USED IN DETERGENTS, prepared for the Minor Additives Committee of the Soap and Detergent Association, Mar. 1, 1973, by Arthur D. Little, Inc., the disclosures of which are incorporated herein by reference, as well as in Canadian Pat. No. 823,683, cited hereinabove.

The bis(styrylsulfonate)biphenyl, of the following formula

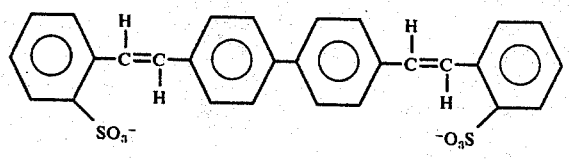

is commercially available as the desired fluorescent trans isomer. The trans isomer will convert to a cis, trans mixture on irradiation, and such mixtures are also useful herein.

The bis(styrylsulfonate)biphenyl brightener herein can be used in its neutralized, water-soluble salt form, i.e., compounds of the above formula wherein a counterion, M, which can be an alkali metal such as sodium, potassium, etc., provides electrical neutrality. The brightener can also be used in its free acid form, which is substantially neutralized in the preferred detergent compositions herein.

CARRIER

Although useful detergent compositions of the instant invention need only contain the above-described components (i.e., thick, anhydrous compositions), highly preferred compositions herein contain, in addition to the active detersive components, a liquid carrier selected from the group consisting of water and mixtures of water and water-soluble solvents. Such carriers can be used to the extent of from about 5% to 70%, preferably 20% to 60%, by weight of the total detergent composition. In highly preferred compositions the carrier comprises from about 25% to 45% by weight of the total composition.

Use of the carrier liquids at the above-disclosed levels in the compositions herein has several advantages. First, the physical stability of the detergent compositions is improved by dilution, and clear points are lowered. Stated otherwise, compositions formulated using liquid carriers do not cloud at the low temperatures which are commonly encountered during shipping or storing of commercially marketed detergent compositions.

Secondly, liquid carriers, especially water-alcohol mixtures, help control viscosity and regulate the gelling tendency which liquid detergent compositions of the instant type exhibit after dilution with water.

When an alcohol-water mixture is employed as a carrier, the weight ratio of water to alcohol preferably is maintained above about 2:1, more preferably from about 3:1 to about 10:1. Higher alcohol (particularly ethanol) concentrations in the water-alcohol mixtures used as carriers herein are preferably avoided because of flammability problems which may arise at such higher alcohol levels.

Any alcohol containing from 1 to about 5 carbon atoms can be employed in the water-alcohol carrier used to prepare the instant detergent compositions. Examples of operable alcohols include methanol, ethanol, propanol, isopropanol, butanol, isobutanol, and pentanol; ethanol is highly preferred for general use.

Various liquid or low-melting, water-soluble poly-ols can also be used in the carriers herein. Such materials include, for example, polyethylene glycol, especially the ethylene glycols in the molecular weight range of 500–1500; the polyethoxylated poly-ols commercially available as Carbitol; glycerines and polymers thereof; and the like.

Other water-soluble solvents which can be used herein in a manner similar to the alcohols include: ketones such as acetone; aldehydes such as propionaldehyde; ethers such as diethyl ether, and the like; as well as various natural water-soluble oils which contain such water-soluble organic solvents.

OPTIONAL COMPONENTS

The present compositions can optionally contain various non-interfering components which contribute to overall aesthetics, ease-of-use and performance.

One type of optional component which can be added to the detergent compositions of the instant invention is an electrolyte salt. As pointed out in U.S. Pat. Nos. 2,580,173 and 3,440,171, electrolyte salts lessen undesirable gel formation which can occur with concentrated detergent compositions. This gel formation can occur, not in the product, itself, but in measuring caps when a small quantity of water comes in contact with the concentrated composition. On the other hand, many electrolytes can cause phase separation in the instant compositions, so it is necessary to select non-interfering electrolyte degellants, i.e., those which do not contribute to phase separation and to use such degellants at non-interfering levels, i.e., generally 1% by weight of composition, or less. Potassium hydroxide and potassium chloride are useful herein without causing phase separation. Potassium hydroxide and/or potassium chloride, used herein in combination with a water-alcohol solvent at a level of from about 0.1% to about 1% by weight of composition, can help eliminate gelling problems without the need for excessively high alcohol levels.

Other optional, non-essential, non-interfering components can be added to the compositions prepared herein to provide improved performance or aesthetic appeal. For example, compositions containing a color stabilizing agent such as citric acid are preferred from an aesthetic standpoint. Citric acid (or citrate) containing compositions exhibit surprising stability against the tendency of compositions of the present type to develop a reddening upon storage. In addition, the presence of citric acid in the compositions has a beneficial effect from the standpoint of preventing reddish stains from developing on the outer surfaces of plastic bottles after spillage, seepage or handling of bottles with hands previously contacted with the compositions herein. An amount of citric acid of up to about 1% by weight of composition (based on its free acid form) can be added to obtain these color stabilizing benefits. A highly preferred range for the added citric acid is from about 0.05% to about 0.3% by weight of composition.

Suds modifying agents can be present in the instant compositions in minor proportions to provide high foaming or low foaming products, as desired. While the compositions herein inherently provide adequate suds levels, some users desire copious lather from laundry detergent products. Accordingly, the compositions herein can optionally contain suds boosters. Nonionic surfactants in the $C_{10-14}EO_{4-9}$ range are quite useful for this suds boosting purpose, as are ABS-type anionics. Various suds suppressors, such as the silicones or polyethyleneoxide polypropylene oxide copolymers known in the detergency arts can be used if low-sudsing compositions are desired.

Other optional components herein are listed in many commercial publications and include enzymes, bleaching agents, anti-microbial agents, corrosion inhibitors, perfumes and coloring agents. Such components usually will comprise no more than about 3% by weight of the total composition.

The fatty acids noted hereinabove are useful stabilizers which apparently help scavenge interfering impurities.

PREPARATION AND USAGE

The compositions herein are prepared by combining the alkaline earth anionic surfactant with the other indicated components and optional ingredients in a liquid carrier, whereupon the ingredients dissolve to provide a stable, clear liquid composition. The alkaline earth anionic surfactant can be employed in that form, or can conveniently be prepared in situ by neutralizing the free acid form of the anionic surfactant with, for example, magnesium hydroxide, calcium hydroxide, etc. On the other hand, it is not desirable to prepare the alkaline earth metal surfactant by simply combining, for example, the sodium salt of the anionic surfactant with, for example, a magnesium halide. In such instances a quantity of sodium chloride, or other corresponding electrolyte salt, will be formed. The presence of copious amounts of such additional, undesirable salts in the compositions herein can cause phase separation, apparently by the so-called "salting-out" effect. The presence of such undesirable electrolyte salts at interfering levels is to be avoided.

As noted hereinabove, the presence of high levels of alkanolamines is avoided to prevent precipitation of the brightener. However, minor amounts of alkanolamines (e.g., monoethanolamine, diethanolamine or triethanolamine) can be used to adjust the pH of the compositions in the manner described below. The amount of alkanolamine which can be tolerated will depend, for example, on the carrier system used, the concentration of brightener, etc., and can easily be determined experimentally for a given composition.

Preferred compositions herein are those which are prepared at a pH in the range from about 6 to 10, inasmuch as detergency performance is increased at pH's at, or above, substantial neutrality. For most purposes, a pH in the range of from about 8.0 to about 10.0 is preferred. With the magnesium salts a pH in the range much above about 8.5 is preferably avoided, inasmuch as magnesium hydroxide begins to precipitate from concentrated compositions above the pH.

While not intending to be limited by theory, it appears that the presence of the alkaline earth metal moiety in the present compositions promotes aggregation of the anionic surfactant at interfaces. This aggregation, in turn, promotes detergency. Accordingly, it is most preferred to use sufficient magnesium ion, calcium ion, or mixtures thereof to provide electrical neutrality to the anionic surfactant and to provide, in addition, from about 3% to about 5% of excess magnesium ion, calcium ion, or mixtures thereof in the compositions beyond that required for electrical neutrality. As noted hereinabove, this quantity of the alkaline earth metal is conveniently and desirably incorporated in the compositions in the form of the metal hydroxides during the in situ generation of the alkaline earth metal surfactant via the neutralization process.

Highly preferred compositions prepared in the foregoing manner comprise from about 17% to about 25% by weight (based on the free acid form) of an anionic detersive surfactant selected from the group consisting of the $C_9$–$C_{14}$ linear alkyl benzene sulfonates, $C_9$–$C_{14}$ linear alkyl toluene sulfonates, $C_9$–$C_{14}$ branched-chain alkyl toluene sulfonates, and mixtures thereof; sufficient magnesium ion, calcium ion, or mixtures thereof, especially magnesium ion, to impart electrical neutrality to said anionic surfactant, or mixtures thereof, and to provide, in addition, from about 3% to about 5% of excess magnesium ion, calcium ion, or mixtures thereof, over that needed for electrical neutrality; and from about 20% to about 40% by weight of an ethoxylated nonionic detersive surfactant selected from the group consisting of $EO_6$–$EO_{16}$ ethoxylates of primary and secondary straight-chain and branched-chain alcohols containing from about 9 to about 16 carbon atoms. The compositions will additionally comprise from about 0.1% to about 1% by weight of bis(styrylsulfonate)biphenyl, added as the trans form. The balance of the compositions will comprise a liquid carrier selected from the group consisting of water and water-ethanol mixtures. Such compositions will be prepared in the foregoing manner and will be substantially free of interfering agents at levels which cause phase separation or brightener precipitation.

The present compositions are used, both as through-the-wash and pre-treatment cleaning agents, in the manner disclosed above. The following examples illustrate the compositions herein and their method of preparation and use, but are not intended to be limiting thereof.

EXAMPLE I

A stable, clear liquid detergent composition is as follows:

| Ingredient | % (wt.) |
|---|---|
| $C_{11.2}$LAS, acid form | 16.5 |
| Tallow alcohol $(EO)_{11}$ | 6.0 |
| Dobanol 91-8* | 19.0 |
| Magnesium hydroxide | 1.75 |
| Brightener** | 0.3 |
| Oleic acid | 1.0 |
| Ethanol | 5.0 |
| Citric acid | 0.2 |
| Minors (dye, perfume, etc.) | 0.2 |
| Water | Balance |

*Branched "OXO" alcohols in the 9-11 chain length with an 8 ethoxylate average, available from Shell; said alcohols having been vacuum stripped of the free alcohols and lower ethoxylates to help control odor.
**bis(styrylsulfonate)biphenyl The composition of Example I is prepared by simply admixing the LAS (acid form) and the magnesium hydroxide in the water carrier. After the LAS is substantially neutralized, the remaining ingredients are added. The ingredients are stirred until dissolved and a clear, stable liquid is secured.

In contrast with the composition of Example I, a similar liquid detergent comprising the brightener, an anionic surfactant, a nonionic surfactant, and a water-ethanol carrier is prepared, using ca. 1% by weight of free triethanolamine as an additional component. On standing, a precipitate of what appears to be the triethanolammonium salt of the brightener ingredient is formed.

The composition of Example I is used at a concentration of ca. 0.15% by weight in an aqueous laundering liquor at a temperature of ca. 110° F to launder a mixed load of cotton, cotton/polyester and polyester fabrics. Oily soils and stains on the fabrics are substantially removed during the laundering operation, which is carried out in a standard, top-loading automatic washer. Excellent brightener performance is noted. The detergency performance of the composition of Example I is substantially equivalent to that of a commercial heavy-duty liquid laundering composition comprising a mixture of a triethanolammonium LAS surfactant, a nonionic surfactant mixture, and free triethanolamine.

The composition of Example I is also characterized by its excellent suds profile. Accordingly, the composition is also useful in front-loading machines and in wringer-type washers at temperatures from about 90° F to about 180° F.

EXAMPLE II

A clear, stable, heavy-duty liquid detergent composition is as follows:

| Ingredient | % (wt.) |
|---|---|
| Brightener* | 0.1 |
| Softanol** | 16.5 |
| $C_{11.2}$LAS, free acid form | 16.5 |
| Magnesium hydroxide | 1.75 |
| Ethyl alcohol | 9.0 |
| Water | Balance |

*bis(styrylsulfonate)biphenyl
**$C_{12-13}$ (avg.) secondary alcohol mix ethoxylated to an average $(EO)_{12}$ chain; available from Nippon Shokubei. The commercial mixture is substantially free from non-ethoxylated alcohols and short-EO ethoxylates.

The composition of Example II is prepared in the same manner as that of Example I, i.e., by first allowing the LAS and magnesium hydroxide to react before adding the other ingredients to the liquid carrier.

An aliquot of the composition of Example II is poured full-strength onto heavily soiled areas of fabrics. The fabrics are rubbed and thereafter placed in a standard, top-loading automatic washer together with an additional aliquot of the composition (total composition 1/4 cup). The machine is operated according to manufacture's instructions. After rinsing and drying, oily stains are found to be removed.

In the composition of Example II, the $C_{11.2}$LAS is replaced by $C_{12\ (avg.)}$ABS and a high sudsing product is secured.

In the composition of Example II, one-half the $C_{11.2}$LAS is replaced by $C_{12-13}$ABS and an excellent moderate-to-high sudsing product is secured.

In the composition of Example II the $C_{11.2}$LAS is replaced by an equivalent amount of $C_{11.8}$LAS and substantially equivalent results are secured.

The composition of Example II is modified by adding sufficient KOH to provide a pH of ca. 8.4. A stable, non-gelling product is secured.

EXAMPLE III

Stable, homogeneous liquid detergents are prepared using the following ingredients in the manner of the composition of Example I, above. The anionic surfactants listed are in their free acid form. The brightener is bis(styrylsulfonate)biphenyl, as the acid form; the sodium salt form is equally useful.

| INGREDIENT | % (wt.) COMPOSITION | | | | | |
|---|---|---|---|---|---|---|
| | A | B | C | D | E | F |
| $C_{11.2}$ LAS | 10 | — | 15 | 15 | 20 | 25 |
| $C_{12(avg.)}$ ABS | — | 20 | 15 | — | — | — |
| Sulfated $C_{9-12}$ $(EO)_{6-12}$ | — | 5 | — | — | — | — |
| Sulfated Tallowalkyl $(EO)_{6-12}$ | — | — | 5 | — | — | — |
| Tallow Acids | — | — | 1 | — | — | — |
| Coconut Acids | 5 | — | — | 1 | — | 1 |
| Tallowalcohol Sulfate | — | — | — | 10 | — | — |
| Coconutalcohol Sulfate | — | — | — | 10 | — | 5 |
| $C_{11.8\ (avg.)}$ Toluene Sulfonate | — | 5 | 5 | — | 5 | — |
| Brightener | 0.1 | 0.2 | 0.6 | 0.9 | 1.0 | 1.0 |
| Ethanol | 5 | 10 | 15 | — | — | 20 |
| Iso-propanol | — | — | — | 15 | 20 | — |
| n-$C_{14}H_{29}(EO)_5$ | 5 | — | — | 5 | — | — |
| 2-$C_{14}H_{29}(EO)_6$ | 5 | — | 10 | 5 | — | — |
| Coconutalcohol $(EO)_6$ | — | 40 | 20 | 25 | 25 | 25 |
| $Mg(OH)_2$ | 1.5 | 1.75 | 1.0 | 1.7 | — | 1.7 |
| $Ca(OH)_2$ | — | — | 1.0 | — | 1.7 | — |
| Water | —— Balance —— | | | | | |

EXAMPLE IV

Stable, homogeneous liquid detergents are prepared using the following commercial ingredients in the manner of Example I, above. The anionic surfactants listed are used in their free acid form. The brightener is bis(-styrylsulfonate)biphenyl, as the free acid form; the sodium and potassium forms are equally useful.

| INGREDIENT | % (wt.) COMPOSITION | | | | | |
|---|---|---|---|---|---|---|
| | A | B | C | D | E | F |
| Conoca SA 515 | 20 | 25 | — | — | — | 20 |
| Calsoft LAS 99 | — | — | 10 | 20 | 30 | 10 |
| Softanol | 20 | — | — | — | — | — |
| Tergitol 15-S-9 | — | 30 | — | — | — | — |
| Kyro EOB | — | — | 40 | — | — | — |
| Neodol 23-6.5 | — | — | — | 20 | — | — |
| Dobanol 91-8 | — | — | — | — | 20 | — |
| Neodol 45-7 | — | — | — | — | — | 25 |
| Brightener | 0.3 | 0.4 | 0.5 | 0.5 | 0.4 | 1.0 |

-continued

| INGREDIENT | % (wt.) COMPOSITION A | B | C | D | E | F |
|---|---|---|---|---|---|---|
| $Mg(OH)_2$ | 1.7 | 1.8 | 1.1 | — | 0.9 | 1.78 |
| $Ca(OH)_2$ | — | — | 0.6 | — | 1.0 | — |
| $Sr(OH)_2$ | — | — | — | 2.0 | — | — |
| Ethanol | 10 | 20 | 15 | 12 | 5 | 10 |
| t-Butanol | — | 10 | — | 8 | — | — |
| Water | —— Balance —— | | | | | |

What is claimed is:

1. A homogeneous, single-phase, heavy-duty liquid detergent composition, comprising:
   a. from about 10% to about 40% by weight based on the free acid form of an anionic detersive surfactant, or mixtures thereof;
   b. sufficient magnesium ion or calcium ion, or mixtures thereof, to provide electrical neutrality for said anionic surfactant;
   c. from about 10% to about 50% by weight of an ethoxylated nonionic detersive surfactant, or mixtures thereof;
   d. an effective amount of a water-soluble bis(styrylsulfonate)biphenyl brightener or water-soluble salt thereof;
   e. the balance of the composition comprising a liquid carrier selected from water or mixtures of water and water-soluble solvents, said composition being substantially free of agents at levels which cause phase separation or brightener precipitation.

2. A composition according to claim 1 wherein the total anionic-plus-nonionic surfactant comprises from about 30% to about 80% by weight of the composition.

3. A composition according to claim 2 wherein the weight ratio of nonionic surfactant to anionic surfactant (free acid form) is in the range from 40:13 to 10:40.

4. A composition according to claim 3 wherein the weight ratio of nonionic surfactant to anionic surfactant (free acid form) is in the range from 25:15 to 10:40.

5. A composition according to claim 1 wherein the anionic surfactant is selected from the group consisting of alkaryl sulfonates, wherein the alkyl group contains from about 9 to about 14 carbon atoms, and mixtures thereof; alkyl and olefinic sulfates and sulfonates, wherein the alkyl or olefin group contains from about 10 to about 18 carbon atoms, and mixtures thereof; ethoxylated alkyl sulfates and sulfonates having an ethylene oxide chain of from about 1 to about 14 ethoxyl groups and an alkyl group containing from about 10 to about 18 carbon atoms, and mixtures thereof; fatty acid soaps; and mixtures thereof.

6. A composition according to claim 1 wherein the ethoxylated nonionic surfactant is selected from the $EO_1$ to $EO_{20}$ ethoxylates of primary and secondary alcohols containing from about 9 to about 18 carbon atoms, and mixtures thereof.

7. A composition according to claim 1 having a pH in the range from about 6 to about 8.5.

8. A composition according to claim 7 having an excess of magnesium ion, calcium ion, or mixtures thereof, over that needed to provide electrical neutrality of the anionic surfactant.

9. A composition according to claim 8 wherein the excess magnesium ion, calcium ion, or mixtures thereof comprises from about 3% to about 5% by weight over that needed to provide electrical neutrality of the anionic surfactant, said composition having a pH in the range from about 6 to about 8.0.

10. A composition according to claim 1, comprising:
   a. from about 17% to about 25% by weight based on the free acid form of an anionic detersive surfactant selected from the group consisting of the $C_9$–$C_{14}$ linear alkyl benzene sulfonates, branched-chain alkyl benzene sulfonates, linear alkyl toluene sulfonates, branched-chain alkyl toluene sulfonates, and mixtures thereof;
   b. sufficient magnesium ion, calcium ion, or mixtures thereof, to provide electrical neutrality to said anionic surfactant and to provide, in addition, from about 3% to about 5% by weight of excess magnesium ion, calcium ion, or mixtures thereof over that needed to provide electrical neutrality;
   c. from about 20% to about 40% by weight of an ethoxylated nonionic detersive surfactant selected from the group consisting of $EO_6$–$EO_{16}$ ethoxylates of primary and secondary straight chain and branched-chain alcohols containing from about 12 to about 16 carbon atoms, and mixtures thereof;
   d. from about 0.1% to about 1% by weight of bis(styrylsulfonate)biphenyl, or water-soluble salt thereof;
   e. the balance of the composition comprising a liquid carrier selected from the group consisting of water and water-ethanol mixtures, said composition being substantially free of agents at levels which cause phase separation or brightener precipitation.

* * * * *